US008282773B2

(12) United States Patent
Aichinger et al.

(10) Patent No.: US 8,282,773 B2
(45) Date of Patent: Oct. 9, 2012

(54) METHOD AND SYSTEM TO ENHANCE FIBER DEVELOPMENT BY ADDITION OF TREATMENT AGENT DURING MECHANICAL PULPING

(75) Inventors: Johann Aichinger, Pregarten (AT); Marc Sabourin, Beavercreek, OH (US); Jan Hill, Tyringe (SE); Johann Grossalber, Baden (AT)

(73) Assignee: Andritz Inc., Glens Falls, NY (US)

( * ) Notice: Subject to any disclaimer, the term of this patent is extended or adjusted under 35 U.S.C. 154(b) by 359 days.

(21) Appl. No.: 12/257,666

(22) Filed: Oct. 24, 2008

(65) Prior Publication Data

US 2009/0151880 A1 Jun. 18, 2009

Related U.S. Application Data

(60) Provisional application No. 61/013,891, filed on Dec. 14, 2007.

(51) Int. Cl.
*D21B 1/02* (2006.01)
*D21B 1/16* (2006.01)

(52) U.S. Cl. ..... 162/24; 162/25

(58) Field of Classification Search ..... 162/24, 162/25

See application file for complete search history.

(56) References Cited

U.S. PATENT DOCUMENTS

| | | | | |
|---|---|---|---|---|
| 3,023,140 | A | 2/1962 | Textor | |
| 6,267,841 | B1 | 7/2001 | Burton | |
| 7,300,541 | B2 | 11/2007 | Sabourin | |
| 2005/0011622 | A1 | 1/2005 | Sabourin | |
| 2005/0241785 | A1 * | 11/2005 | Peng et al. | 162/72 |

FOREIGN PATENT DOCUMENTS

| | | | |
|---|---|---|---|
| EP | 0333398 | A2 | 9/1989 |
| EP | 1541753 | A1 | 6/2005 |
| WO | 9106700 | A1 | 5/1991 |
| WO | WO 97/40194 | A1 * | 10/1997 |
| WO | 2004009900 | A1 | 1/2004 |
| WO | 2005042830 | A1 | 5/2005 |

OTHER PUBLICATIONS

Search Report completed Mar. 19, 2009.

* cited by examiner

*Primary Examiner* — Anthony Calandra
(74) *Attorney, Agent, or Firm* — Nixon & Vanderhye P.C.

(57) ABSTRACT

A mechanical pulping method including: defibrating a comminuted cellulosic material; mechanically refining the defibrated cellulosic material in a primary refining step; introducing to the cellulosic material at least one of a chemical agent and a biological during the defibration step or the mechanical refining step, and producing pulp from the refined and defibrated cellulosic material.

5 Claims, 7 Drawing Sheets

METHOD AND SYSTEM TO ENHANCE FIBER DEVELOPMENT BY ADDITION OF TREATMENT AGENT DURING MECHANICAL PULPING

CROSS RELATED APPLICATION

This application claims the benefit of U.S. Provisional Application No. 61/013,891 filed Dec. 14, 2007, the entirety of which is incorporated by reference.

BACKGROUND OF THE INVENTION

The present invention relates to separating fibers from lignocellulosic materials, such as the separating fibers from wood chip feed material. The invention particularly relates to mechanical refining, including chemi-mechanical pulping (CMP) and thermomechanical pulping (TMP).

In some conventional mechanical refining processes, the steps of defibration and fibrillation are performed together in a single mechanism. The benefits of separating the steps of wood fiber defibration and fiber fibrillation are discussed in, for example, U.S. Pat. No. 7,300,541 ('541 patent), which is based on published international patent application PCT/US03/22057. When fibers are defibrated prior to fibrillation, the primary refining step may be optimized for fibrillation. The optimization for fibrillation may be to minimize energy dissipation by increasing refining intensity. A method to separate the defibration and fibrillation steps is described in the '541 patent a using a pressurized chip press followed by gentle refining to separate fibers in a pretreatment stage (referred to as a "defibration step") and thereafter by high intensity pressurized primary refining stage (the "fibrillation step").

BRIEF DESCRIPTION OF THE INVENTION

Specific treatment agents have been developed to be applied to defibrated wood fibers to enhance the efficiency and quality development of mechanical refining process. The treatments may include acidic, neutral or alkaline chemical agents, and enzymatic agents. The type of agent(s) and the point(s) in the refining process of application of the agent to the defibrated wood fibers may be optimized to enhance process efficiency. Process efficiency may be defined by any one or more of physical pulp quality, enhanced brightness, and energy savings. The treatments with agents disclosed herein may also provide: 1) an ability to utilize in a refining process inferior wood species and sawmill residues, and 2) simplification of the refining process downstream of the primary refining stage.

The treatments with agents disclosed herein may be applied to target specific application points of agents during the thermal and mechanical refining process, such as described in the '541 patent. Depending on the agent used in the treatment, the application point of the agent may be during or immediately following one or more of a defibration step (preferably using enzymatic agents), during a fibrillation step (preferably using chemical agents) and/or immediately following a fibrillation step (preferably using bleaching agents). The selected agent is an important factor in determining the optimum point to apply the agent to the refining process to, for example, improve process efficiency.

The processes and treatments disclosed herein preferably are preformed such that defibration and fibrillation are separate stages, and preferentially preformed in separate mechanisms. Alternatively, the separation of the defibration and fibrillation steps may be preformed in a single mechanism, such in a mechanical refiner having two or more refining zones arranged in series. Preferably, the defibration step achieves at least a 30 percent (30%) conversion of intact wood fibers to well separated fibers, and preferably greater than 70 percent (70%) conversion with less than 5% fibrillation. From the pre-treatment (defibration) step, the defibration level preferably results in 40 percent to 90 percent (40% to 90%) of separated fibers in the material. The primary refiner step (fibrillation) should preferably achieve at least 90 percent (90%) of fibrillated fibers.

The processes and treatments disclosed herein may be applied to lignocellulosic materials including wood chips from softwoods and hardwoods, other types of lignocellulosic material, including material that is currently viewed as less desirable for use in the existing mills.

A mechanical pulping method has been invented that in one embodiment includes: defibrating a comminuted cellulosic material; mechanically refining the defibrated cellulosic material in a primary refining step; introducing to the cellulosic material at least one of a chemical agent and a biological during the defibration step or the mechanical refining step, and producing pulp from the refined and defibrated cellulosic material.

The mechanical pulping method may include introducing the chemical agent to the cellulosic material when in the primary refining step and the biological agent to the cellulosic material when in the pre-treatment step. Further, the defibration step may include a pressurized chip press stage and subsequently a fiberizer refiner stage. And, the introduction of the biological agent may be in the pre-treatment step and specifically between pressurized chip press stage and the fiberizer refiner stage or directly into the fiberizer refiner stage.

A mechanical pulping apparatus has been invented that in one embodiment comprises: a pre-treatment defibration device receiving comminuted cellulosic material; a primary refiner receiving the comminuted cellulosic material discharged from the pre-treatment defibration device; a source of at least one of a biological agent and a chemical agent, and a conduit from the source coupled to at least one of the defibration device and the primary refiner, wherein the conduit delivers the at least one of the biological agent and the chemical agent to at least one of the defibration device and the primary refiner.

In another embodiment, a mechanical pulping apparatus comprising: a pre-treatment defibration device receiving comminuted cellulosic material; a primary refiner receiving the comminuted cellulosic material discharged from the pre-treatment defibration device; a source of a biological agent and a chemical agent, and a inlet to the pre-treatment defibration device for a biological agent; a primary refiner receiving the comminuted cellulosic material discharged from the pre-treatment defibration device, and an inlet to the primary refiner for a chemical agent.

DETAILED DESCRIPTION OF THE INVENTION

Refining, in the context of the present application, generally includes a pre-treatment stage (defibration) and a primary refining stage (fibrillation). The pre-treatment stage (defibration) fiberizes the wood chip feed material under mechanically gentle and low intensity conditions, e.g., pressurization, to initiate the separation of individual fibers from the matrix of fibers in a wood chip. The primary refining stage generally involves high mechanical intensity forces, e.g., shearing and impact pulses, that fibrillate the wood chip material into pulp. During fibrillation, the fibers are peeled and fiber wall material is unraveled. The refiners used to fibrillate may be mechanical conical or disc refiners with refining plates having single or multiple refining zones.

Figure 1:
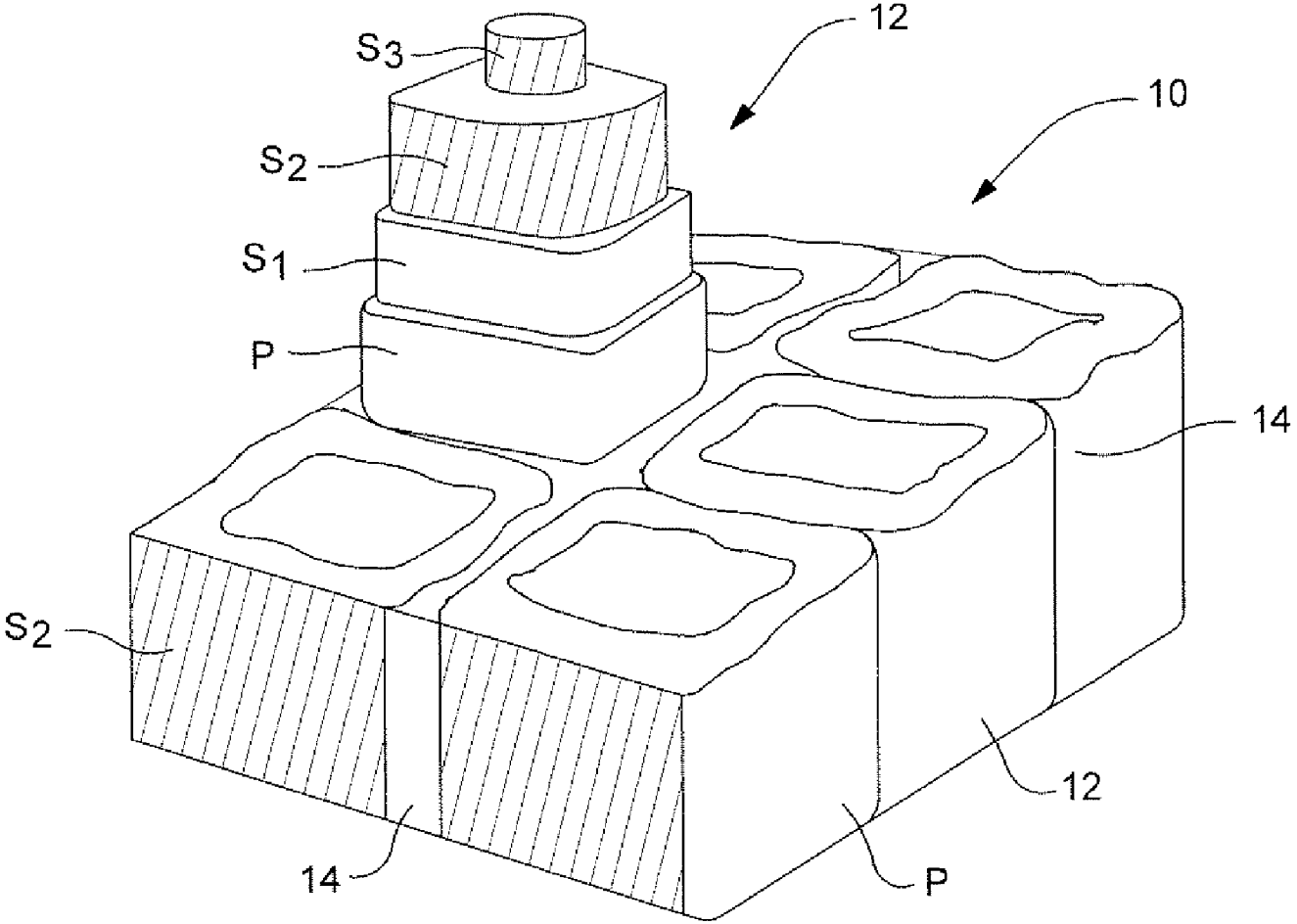
FIG. 1 is a schematic drawing of a section of a wood chip.

FIG. 1 is a diagram of a wood chip 10 having softwood fibers 12 bonded together in a wood chip. The bonding material is primarily found in the middle lamellae 14 between the fibers 12 that contains a high concentration of lignin. The structure of each fiber 12 includes various layers identified as P, and the S layers which include three individual layers labeled S1, S2 and S3. The P layer represents the primary wall of each cell of a fiber. The S layers represent the secondary wall of the fiber cell, wherein the S1 layer is an outer layer of the secondary wall, the S2 layer is a main body of the secondary wall of the fiber, and the S3 layer is an inner layer of the secondary wall.

During fibrillation, the fibril rich layer S2 is delaminated, e.g., peeled off, as much as is practical from each fiber. The S2 layer contains the largest mass of fibrils in the fiber structure. The surface area of bonding material is improved by peeling or by delaminating the S2 layer. An increase in the surface area correlates positively to increases in desirable pulp properties such as tensile strength and scattering coefficient. Fibrillation in the pretreatment stage exposes the fibrous areas of the fiber for subsequent fibrillation in the primary refining stage.

The addition of an agent at one or more stages in the refining process where the material is fiberized or defibrated is believe to cause reactions that open the wood fiber matrix and expose fibrous wall material for efficient softening and maximum fiber fibrillation, e.g., delamination of fibrous wall material. All fiber layers (P, S1, S2 and S3) of the lignocellulosic material 10 receive treatment by the agent. The reaction between the agent and the S2 layer enhances fibrillation of the S2 layer.

The agent may be chemicals (acidic, neutral, alkaline), enzymes, fungus, bacteria, or the like and any combination thereof. The agent may be applied at various locations in the refining mechanism(s) and at various stages of the refining process.

The agent, in one embodiment, is preferably a chemical based agent that is introduced during a primary refining step (fibrillation step) to minimize reaction time between the agent and wood material. Introducing the agent in this manner should lead to preferential softening and reaction of the fiber wall material more so than of the lignin-rich middle lamellae, and, thereby, maximize the exposed specific fiber surface area via delamination of the wall material in the S2 layer, and ultimately fiber bonding. Further, it is preferred that the chemical agents not be applied for long exposure periods to the fiber structure because of the potential for producing long fibers coated in lignin.

In another embodiment, a biological agent, such as an enzyme, may be applied during the defibration step to allow an increase in reaction time of the agent on the wood structure, as compared to the short reaction time resulting by adding a chemical agent in the primary refining stage. Biological agents in general require a retention time of at least 15 minutes to properly react with the wood structures and achieve a desirable benefit in softening the S2 layer. Proper application of the agent, such as the chemical agent in the primary refiner (fibrillation) and the biological agents in the fiberizer refiner (defibration step) is desired to yield enhanced pulp quality.

Following treatment with agent(s), a further mechanical refining device or other pulp device(s) may apply shear and compressive forces to the wood chips to further fibrillate and provide other beneficial properties to the pulp, including brightness enhancement, extractives removal, optical enhancement and fiber development (tensile, elasticity, fiber length, high specific surface, etc.).

The application of an agent, e.g., a chemical or biological agent, to a process stage may provide a reduction of operating costs by improved energy efficiency and optimized chemical usage. Further, by introducing an agent, e.g., chemical agent, to the fillibration process, the agent may provide improved optical properties of the refined pulp, including properties of enhanced light scattering and opacity of the pulp. An enhanced scattering coefficient may be achieved by the agent contributing to a high specific surface of the fibers. The use of agents may also allow for a simplification of the refining process stages and related reductions in investment costs.

Another benefit of applying agents to a refining process is increased extractives removal, which is consideration particularly relevant in refining resinous wood species. When defibrating and opening the fiber structure of a resinous wood, extractives of the wood may be extruded from the wood and processed by downstream dewatering equipment. Another benefit of the application of agents disclosed herein is to improve the homogenization of woods with varying density and extractives content. Adding agents may also improve the bonding ability of inferior woods by 20 percent or more at a given freeness. Additionally, the use of agents may allow for components of wood, for example sawmill residues, to be used as a wood feed material for refining, where such components were not previously useable.

Figure 2:
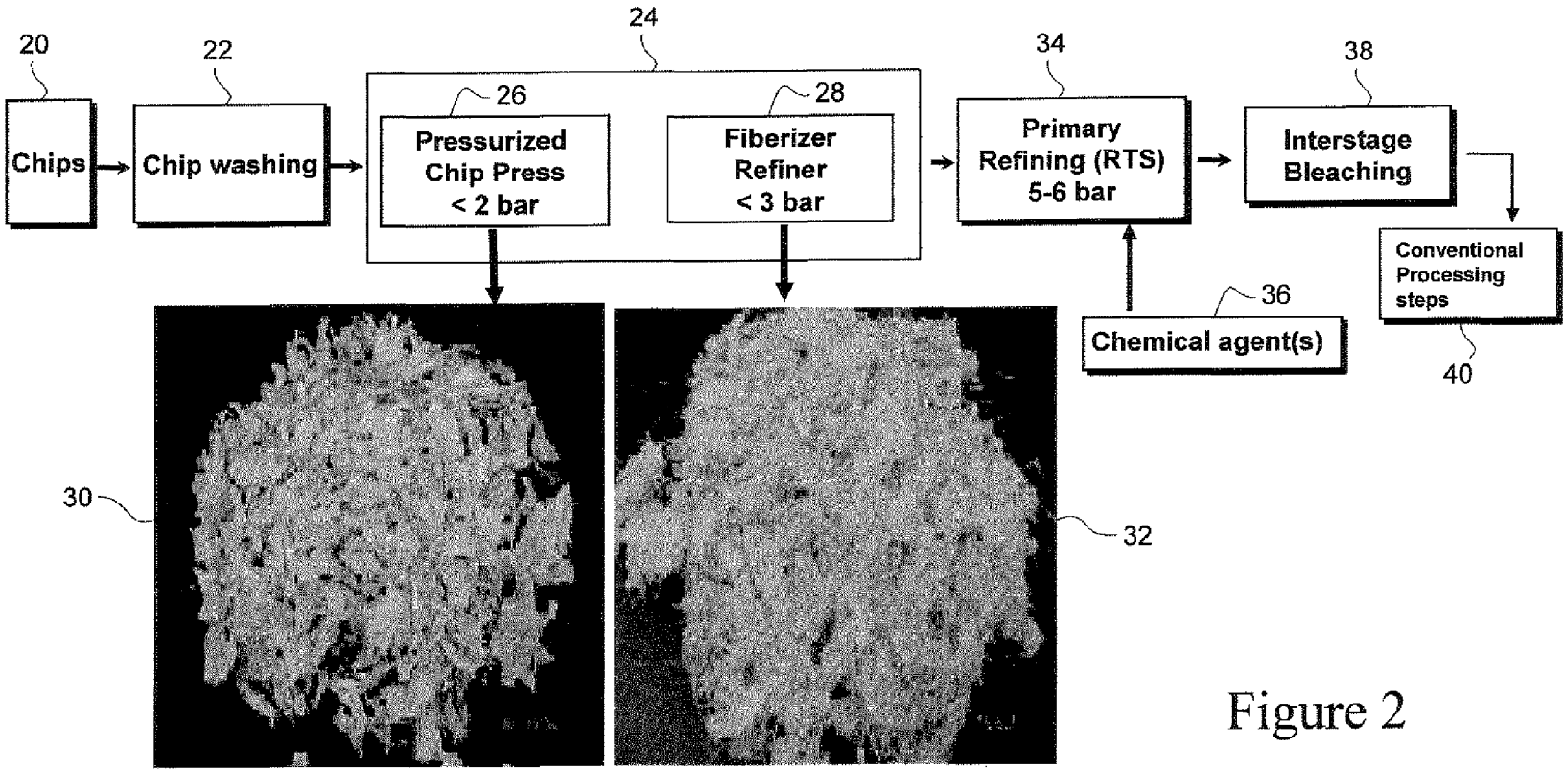
FIGS. 2 to 7 are flow charts of mechanical refining processes using agents, such as chemical and biological agents, to treat lignocellulosic materials undergoing mechanical, chemi-mechanical and thermo-mechanical refining

FIGS. 2 to 7 are flow charts of the application of one or more chemical agents in a mechanical, chemi-mechanical or thermomechanical refining process (collectively referred to as mechanical refining). The flow chart of FIG. 2 is for a full refining treatment, with chemicals and bleaching, of wood chips. Wood chips 20 are fed to a chip washing stage 22 and conveyed to a two-step pre-treatment, e.g., Defibration stage 24. The first step 26 of the pretreatment stage 24 is a pressurized chip press 26 operating at less than 2 bar gauge pressure, which is followed by a fiberizer refining step 28 operating at less than 3 bar gauge pressure. The photographic image 30 shows the wood chips after application of the pressurized chip press 26 and the image 32 shows the wood chips after application of the fiberizer refining step 28. In this pre-treatment stage 24, chemical agents are preferably not added.

Following the pre-treatment stage 24, the wood chips are treated in a primary refining stage (fibrillation) 34 which may include a pressured feeding device, a steaming device, a mechanical disc or conical refiner, wherein the refiner may also include a blowline (e.g., all pressured equipment from the feeder to the blowline) and operate at greater than 3 bar gauge pressure. One or more chemical agents 36 are added to the primary refining stage 34. Adding chemical agents at the primary refining stage may be helpful in reducing the reaction time between the agent and wood material.

Another advantage of adding a chemical agent at the primary refiner stage 34, as opposed to the pretreatment step 24, is that chemicals agents are not squeezed out, e.g., extruded from the wood chips, during pressurization of the wood chips or by a plug screw 33 feeding the primary pressurized refiner.

By allowing the agents to be retained in the chips, the agent reacts with the wood fibers with a full charge of the chemical agent.

The chemical agent(s) may include bleaching chemicals, preferably $MgOH_2$ and $H_2O_2$. If the chemical agent is or is combined with oxidative bleaching liquors, such as alkaline peroxides, the agent and bleach may be introduced: i) directly in the primary refiner 34, ii) in the primary refiner blowline 35, or iii) in a split between the primary refiner and blowline. Adding alkaline bleach liquor as or with the chemical agent at the blowline should reduce or minimize the decomposition of oxidative bleaching agents such as $H_2O_2$. However, the full benefit of energy reduction and strength development attributable to the agent may not be realized unless some or all of the alkaline is added during primary refining stage. Accordingly, the bleach chemical agents may also be added at the inlet to the primary refiner and to the blowline for the refiner.

The bleaching chemical agent may also be discharged from an interstage bleach tower 38 between the primary refiner and subsequent processing steps 40 to enhance the brightening response of the resulting pulp. The use of a bleaching chemical agent in the manner shown in FIG. 2 may allow for the elimination or substantial reduction of further bleaching operations in the conventional processing steps 40.

Figure 3:
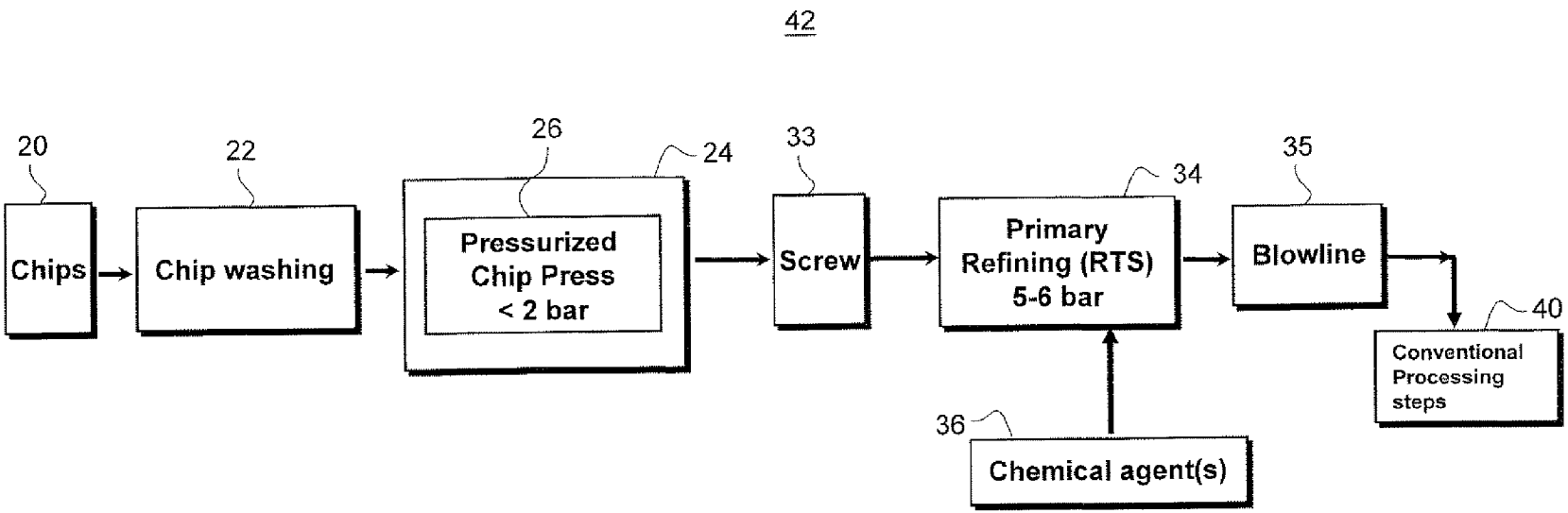

FIG. 3 is a flow chart of an exemplary mechanical refining process 42 where the pre-treatment step (partial defibration) 24 is a single step of a pressurized chip press 26 operating at less than two bar gauge pressure followed by a primary refining stage 34. A screw, e.g., a plug screw, moves the chips from the pretreatment step 24 to the primary refining state 34. The flow chart shown in FIG. 3 represents a medium treatment with chemicals of the wood chips. The primary refining stage 34 may include a pressurized feeding device, a steaming device, a mechanical refiner including a blowline 35, wherein preferably the pressured equipment from the feeder to the blowline operates at greater than 3 bar gauge, and preferably between 5 ad 6 bar. The primary refining stage may be segmented into an inner zone for defibration and outer zone for fibrillation. A chemical agent 36 is added to the primary refining stage 34. If bleaching chemicals are added with chemical agent, an interstage bleach tower (see 38 in FIG. 2) may be included to maximize brightness of the pulp discharged from the primary refining stage. Further, the bleaching chemicals may also be added to the primary refiner inlet and the refiner blowline.

Figure 4:
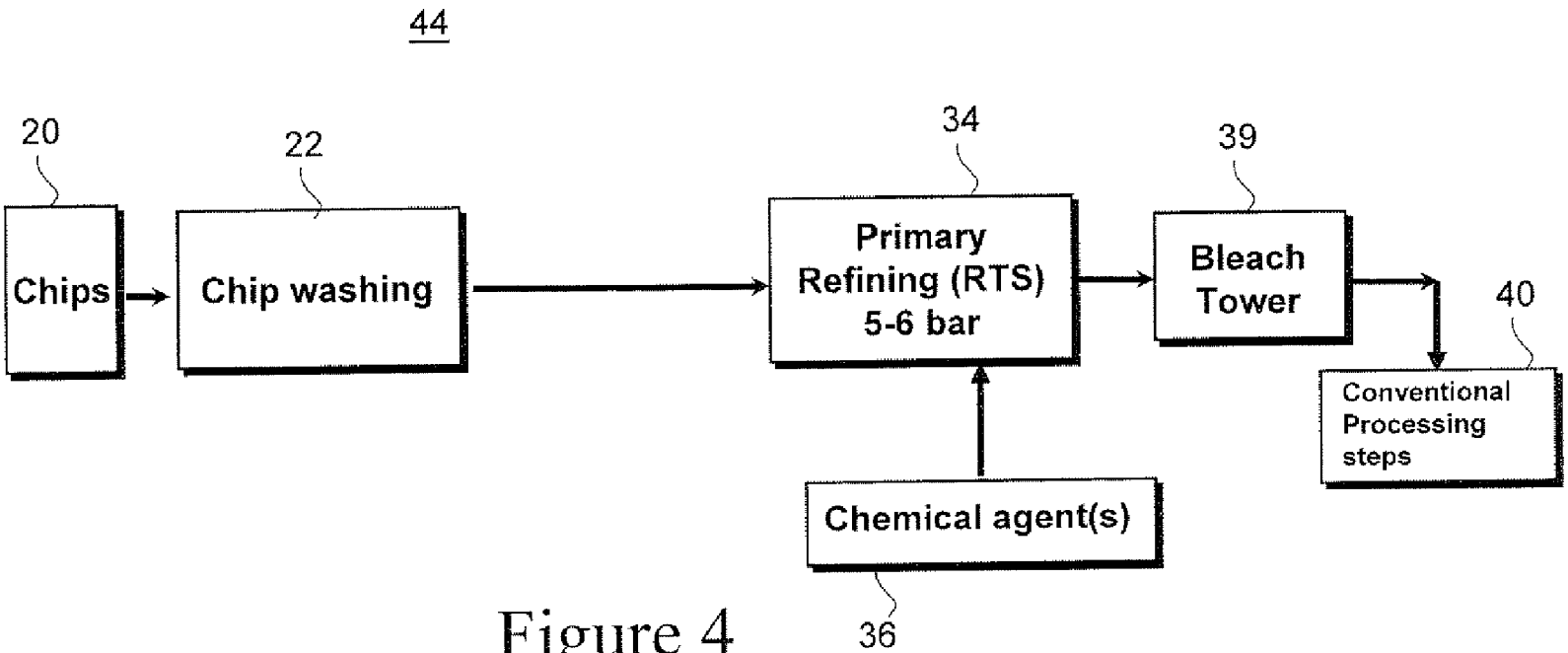

FIG. 4 is a flow chart of a process 44 that does not have a pre-treatment step, such as shown in FIGS. 2 and 3. The process 44 is a light treatment with chemicals. In this process 44, chips 20 from chip washing stage 22 flow directly to the primary refining stage 34 which includes a blowline. In this process 44, the primary refining stage 22 includes at least two distinct refining zones, wherein the first refining zone is arranged to defibrate the wood chips and a subsequent refining zone is arranged to fibrillate the fibers. The primary refining stage 34 may include a pressured feeding device, steaming device, a mechanical refiner including a blowline, wherein preferably the pressured equipment from the feeder to the blowline operates at greater than 3 bar gauge. Bleach chemicals agents may also be added to the inlet to the primary refiner and to the refiner blowline.

The chemical agent 36 preferentially occurs after the defibration refiner plates and before the outer fibrillation refiner plates. In conical refiners the chemical is preferentially added after the flat defibrating plate zone and before the conical fibrillating plate zone. In flat disc refiners the chemical agent is preferentially added after the flat inner defibrating zone and before the flat outer fibrillating zone of refiner plates. Most large flat disc refiners have a circumferential gap between the inner and outer refiner plates where dilution water or a chemical agent may be added.

Bleaching chemicals can be added with or as the chemical agent 36, in a similar fashion as described above for introducing a bleaching agent with or as the chemical agent. If bleaching chemicals are added as part of the chemical agent, an interstage bleach tower 39 may be included between the primary refining stage 34 and conventional processing steps 4.

Figure 5:
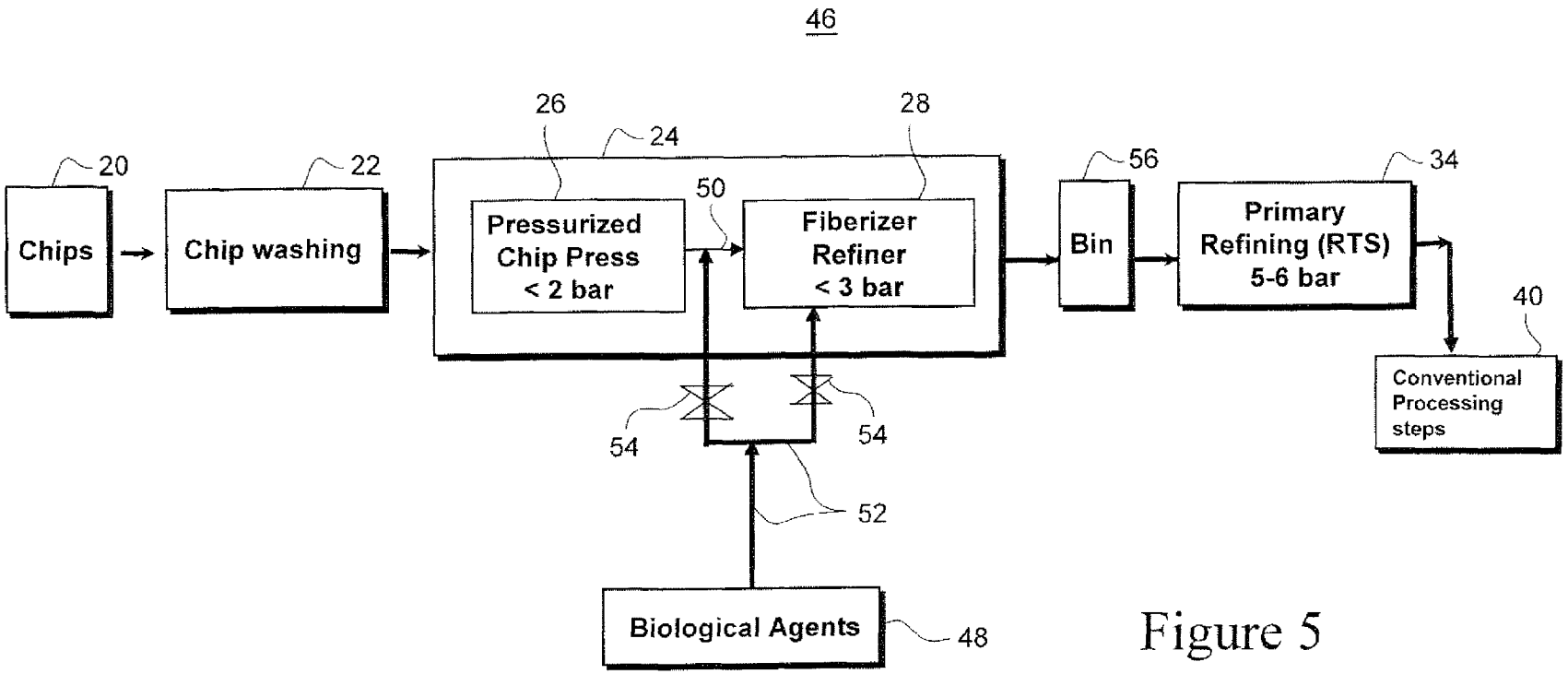

FIG. 5 is a flow chart of a process 46 that uses biological agents. Wood chips 20 are pressed and fed to a chip washing stage 22 and conveyed to a two-step pre-treatment stage 24. The pretreatment stage includes a pressurized stage 26, that preferably includes a chip press operating at less than 2 bar gauge pressure, and a fiberizer refining step 28, preferably operating at less than 3 bar gauge pressure. The process 46 introduces biological agent(s) 48 to the pre-treatment stage 24. The biological agent(s) may be added to one or both of: (1) the discharge line 50 between the pressurized chip press in the pressurized stage and the inlet of the fiberizer refiner in step 28 and (2) directly into the fiberizer refiner. Flow lines 52 and valves 54 direct the biological agent(s) to one or both of the discharge line 50 and the fiberizer refiner 28. The biological agent(s) 48 may also be added to the process 46 between a chip press 20 and the fiberizer refiner 28 and to the fiberizer refiner.

Following the pre-treatment stage 24, a bin 56 in which the wood material is retained for, for example, 15 minutes to 3 hours, to allow for continued reactions between the material and the biological agent. After the bin, the wood material is conveyed to the primary refining stage 34, which may include a pressured feeding device, steaming device, a mechanical refiner including a blowline, wherein preferably the pressured equipment from the feeder to the blowline operates at greater than 3 bar gauge.

Figure 6:
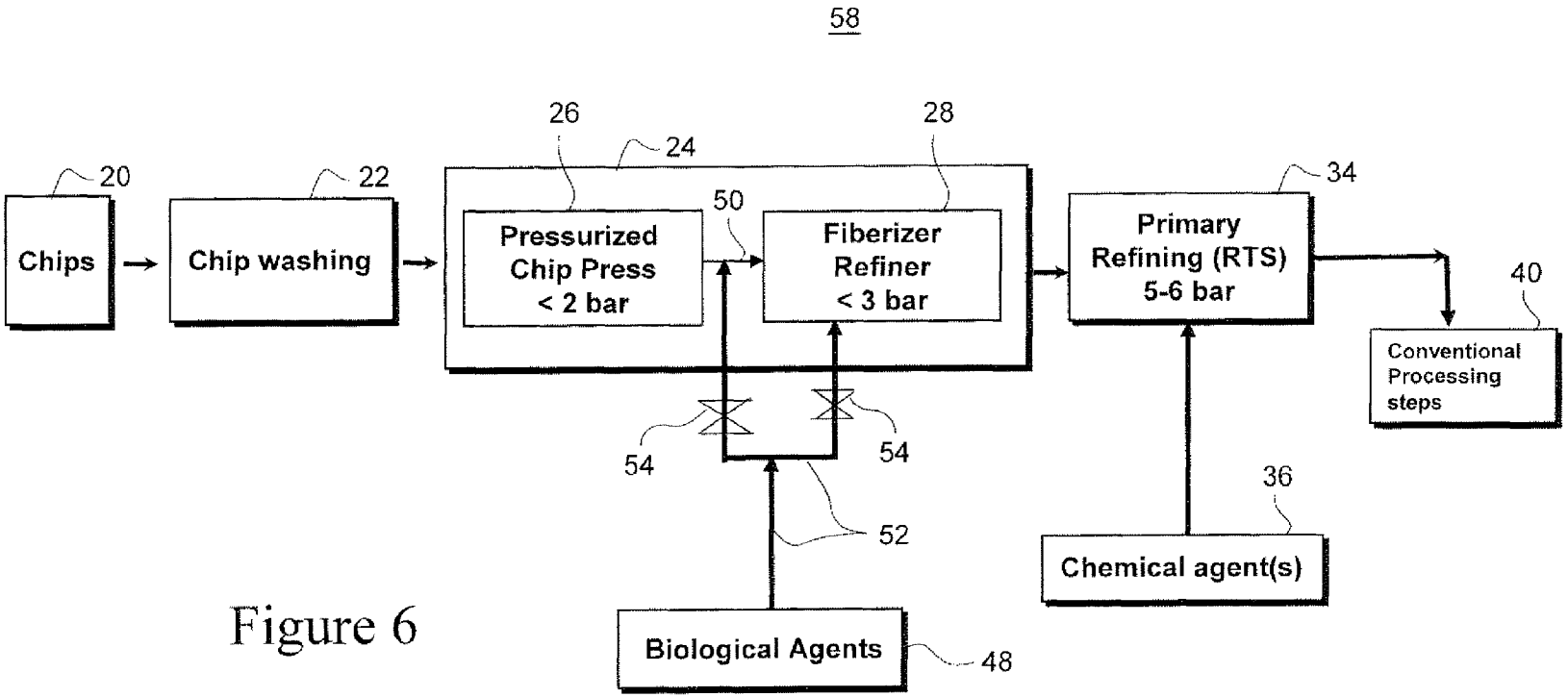

FIG. 6 is a flow chart of a process 58 in which biological agents 48 and chemical agents 36 are applied to the wood material (chips) being refined by the process. The wood chips 20 are pressed and fed to chip washing stage 22, and conveyed to the two-step pre-treatment stage 24. The pressurized chip step 26 may include a pressurized chip press operating at less than 2 bar gauge pressure followed by a second fiberizer refining step 28 operating at less than 3 bar gauge pressure. The biological agent(s) 48 are added to the pre-treatment stage 24. Preferably, the chemical agent(s) are not added to the pre-treatment stage. The biological agents may also be added to the process 58 between the chip press 20 and fiberizer refiner 28 or in the fiberizer refiner. The chemical agents may also be added to the inlet of the primary refiner blowline.

After the pre-treatment stage 24 the wood material is processed by the primary refining stage 34 which may include a pressurized feeding device, steaming device, a mechanical refiner having a blowline, wherein the process from the pressurized feeding device to the blowline operates at preferably greater than 3 bar gauge. The chemical agent 36 is added to the primary refining stage. The chemical agents may include bleaching chemicals, preferably $Mg(OH)_2$ and $H_2O_2$. If a bleaching agent(s) is included as or with the chemical agent, some or all the chemical agent and bleach may be added at the primary blowline. If a bleaching liquor is the only chemical agent used, at least some or all of the chemical agent should be applied at the primary refiner to enhance energy savings and pulp strength development. If a bleaching agent is added, an interstage bleach tower (see FIG. 4) should preferably be between the primary refiner stage 34 and subsequent processing steps 40. The use of bleach agents as or with the chemical agent added to the primary refining stage 34 may allow for the elimination or substantial reduction of bleaching stages in the conventional processing steps 40.

Figure 7:
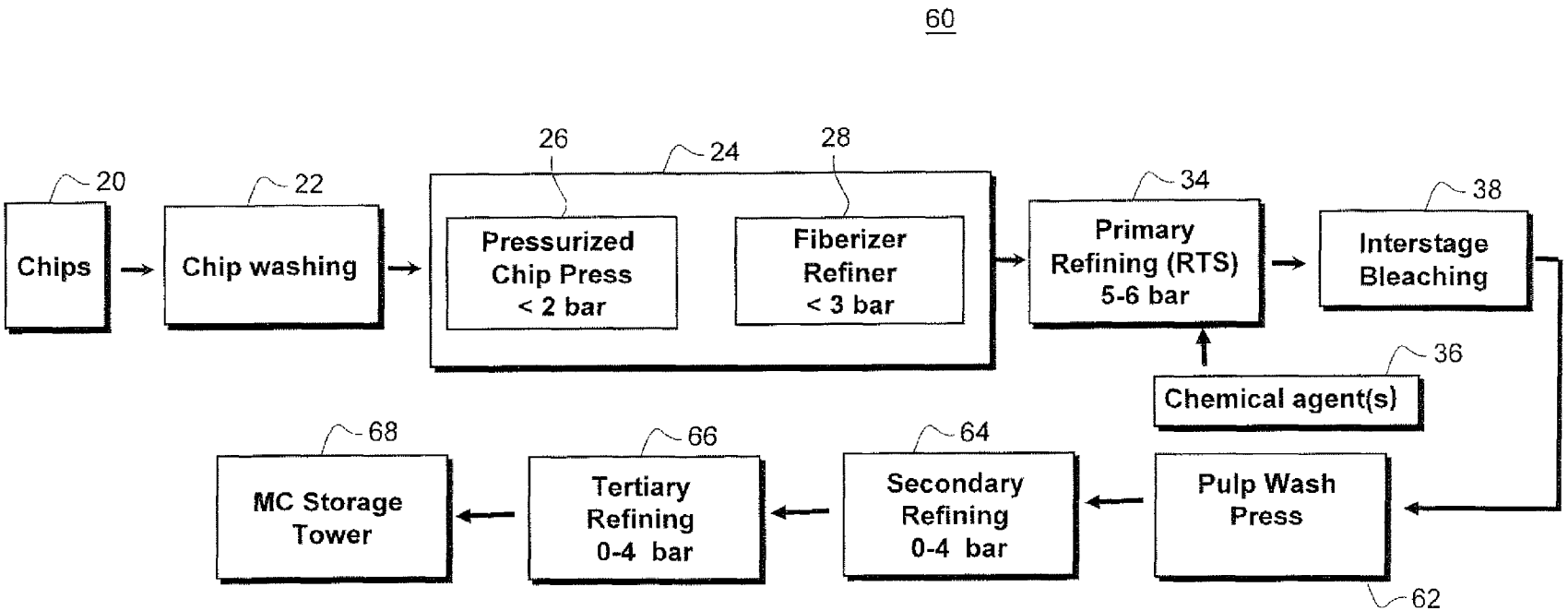

FIG. 7 is a flow chart, e.g., flowsheet, of an exemplary mechanical pulping process 60 in which at least one chemical agent 36. The chemical agent is, by way of example, an alkaline peroxide agents applied at the primary refining stage 34 and the process 60 includes an interstage bleaching stage 38. The process 60 is a simplified refining process, wherein the simplifications include elimination of: i) pressurized screening of the mainline pulp, ii) dewatering and refining of mainline screen rejects, iii) a disc filter dewatering to pulp storage, and iv) a post bleach plant. By eliminating one or more of these mechanism typically found in mechanical pulping processes, there is a substantial cost savings in the installed equipment cost as compared to a conventional thermomechanical pulping system. Further, the process 60 may provided reduced productions costs due to the elimination of one or more of the processes i to iv identified above.

The use of agents, such as chemical and biological agents, to the pretreatment stage 24 and primary refining stage 34 described herein may simplify the scope and complexity of the refining processing steps downstream of the primary refiner stage 34 and, thereby, reduce costs of the downstream equipment. The use of agents as described herein may improve fiber bonding and reduce shive content of the resultant pulp after mainline refining such that no or minimal screening is needed for the mechanical pulping process.

Conventional processing steps may be performed following the interstage bleaching. The steps may include a pulp press and washing stage 62, secondary and tertiary mechanical refining steps 64 and 66 preformed at or below a 4 bar gauge pressure, and a medium consistency pulp storage stage 68 which may include storing the pulp in a storage tower.

Several trials have been completed to demonstrate the usefulness of the invention. These trials are presented in the examples below:

Trial 1:

The location of the addition of an agent to the pulp process should be selected to maximize pulp strength development at a given application of specific energy. The example of trial 1 compares pulps produced using the process with an agent (acid sulfite) applied at two different addition locations; where one is at the defibration stage, and a second is at the fibrillation stage (primary refiner). Table A presents results for both refiner series interpolated at a total specific energy application of 2400 kWh/ODMT.

TABLE A

Comparison of Acid Sulfite applied at Defibration (Fiberizer) versus Fibrillation (Primary Refiner) steps

| Chemical Addition Point | Defibration | Fibrillation |
|---|---|---|
| $Na2SO_3$ (%) | 3.9 | 3.7 |
| Tensile Index at 2400 kWh/ODMT | 39.6 | 42.7 |
| Shive Content (%) at 2400 kWh/ODMT | 0.04 | 0.01 |

The addition of chemical at the fibrillation step reduced the time exposure for the sulfite to react and soften the wood lignin. Preferential fiber softening takes place within the fiber wall material which in turn improves fiber development.

Trial 2:

The trial 2 example shows the importance of increasing wood fiber defibration following chip destructuring. *P. taeda* wood chips were partially defibrated in a pressurized chip press in both examples followed by application of a chemical agent, sodium sulfite, in the refining steps. Table B presents both refiner series interpolated at a freeness of 150 mL.

TABLE B

Effect of Increasing Wood Fiber Defibration prior to Chemical Treatment

| | Without Fiberizer Defibration | With Fiberizer Defibration |
|---|---|---|
| $Na_2SO_3$ (%) | 3.3 | 2.8 |
| Freeness (mL) | 150 | 150 |
| SEC (kWh/ODMT) | 2092 | 1965 |
| Bulk ($cm^3/g$) | 3.36 | 3.28 |
| Tensile Index (Nm/g) | 23.9 | 31.2 |
| Tear Index ($mN \cdot m^2/g$) | 6.8 | 9.2 |
| Shive Content (%) | 0.02 | 0.02 |
| ISO Brightness (%) | 55.2 | 54.9 |

The increased fiber defibration improves the efficiency of chemical penetration into exposed fiber wall material during the primary refining step, with resultant improved pulp quality.

Trial 3:

The example of trial 3 demonstrates that inferior wood species and sawmill residues can be utilized for the production of usable pulps in mechanical printing papers with less negative impact. Trial 3 illustrates the effect of adding 29% *P. taeda* sawmill residues on pulp properties produced using the new process. Table C compares the pulps interpolated at a freeness of 70 mL.

TABLE C

Effect of adding sawmill residues (slabwood chips)

| | Reference Pulp* | 29% Sawmill Chips** | 100% Sawmill Chips |
|---|---|---|---|
| $NaHSO_3$ (%) | 3.4 | 3.2 | 3.1 |
| Freeness (mL) | 70 | 70 | 70 |
| SEC (kWh/ODMT) | 2036 | 2354 | 2495 |
| Bulk (cm3/g) | 2.55 | 2.69 | 2.78 |
| Tensile Index (Nm/g) | 39.6 | 42.3 | 39.0 |
| Tear Index (mN · m2/g) | 8.1 | 8.9 | 9.0 |
| Shive Content | 0.04 | 0.04 | 0.04 |
| ISO Brightness (%) | 52.5 | 50.3 | 48.1 |

Wherein "*" indicates that the chip feed material is produced from 100 percent (100%) whole log *P. taeda* chips and "**" indicates that the chip feed material is produced with 29 percent (29%) sawmill (slabwood) *P. taeda* chips added to whole log *P. taeda* chips.

The resultant pulp produced with 29% sawmill chips (slabwood) had only slightly higher bulk and lower brightness. Increasing the application of acid sulfite ($NaHSO_3$) treatment may be used to equalize pulp properties such as bulk and brightness to that of the reference pulp.

Trial 4:

Trial 4 presents alternative chemical agents applied to the fibrillation step (primary refiner) of the novel process. The wood furnish used for the study was *P. taeda* from Tennessee, USA. Table D presents pulp series produced using two different chemical treatments, wherein the agents are: 1) a bleaching agent solution of magnesium hydroxide ($Mg(OH)_2$), hydrogen peroxide ($H_2O_2$), and 2) acetic acid. A conventional TMP pulp produced from the same *P. taeda* wood chips is also included for comparison. The results are interpolated at a freeness of 150 mL from the secondary refined pulps.

TABLE D

Alternative Chemical Treatments

| | Conventional TMP | Invention | Invention |
|---|---|---|---|
| Chemical Treatment | 0 | 4.0% Acetic Acid | 1.5% $Mg(OH)_2$ 2.4% $H_2O_2$ |
| Freeness (ml) | 150 | 150 | 150 |
| SEC (kWh/ODMT) | 2698 | 2098 | 1831 |
| Tensile Index (Nm/g) | 28.9 | 33.4 | 35.9 |
| Burst Index ($kPa \cdot m^2/g$) | 1.51 | 1.69 | 1.91 |
| Tear Index ($mN \cdot m^2/g$) | 11.5 | 11.4 | 11.6 |
| Scattering Coefficient ($m^2/kg$) | 44.4 | 49.0 | 45.1 |
| ISO Brightness (%) | 47.7 | 36.7 | 59.7 |

Both chemical agents demonstrated an ability to significantly reduce energy consumption and increase pulp strength properties compared to the thermomechanical (TMP) pulp. The series produced with bleaching agents [1.5% $Mg(OH)_2$ and 2.4% $H_2O_2$] resulted in a significant gain in brightness.

The brightness of mechanical pulps from inferior wood species with dark color bearing chromophore structures can be effectively brightened when using the novel process in tandem with bleaching agents and/or interstage retention. Such applications increase the possibility of using inferior woods and the scope of downstream bleaching equipment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the invention.

The invention claimed is:

1. A mechanical pulping method comprising:

defibrating a comminuted cellulosic material in a pre-treatment step and first introducing a biological agent to the comminuted cellulosic material during the pre-treatment step and during or immediately upstream of the defibration of the comminuted cellulosic material;

mechanically refining the defibrated cellulosic material in a primary refining step and first introducing a chemical agent into the defibrated cellulosic material during the primary refining step, and outputting a refined and defibrated cellulosic material from the primary refining step.

2. The mechanical pulping method of claim 1 wherein the introduction the chemical agent includes a bleaching chemical agent.

3. The mechanical pulping method of claim 1 wherein the comminuted cellulosic material includes wood chips and the pre-treatment step includes a pressurized chip press stage, and the method further comprise receiving in a fiberizer refiner stage the cellulosic material output from the chip press stage, wherein the biological agent is first introduced to the fiberizer refiner stage or immediately upstream of the fiberizer refiner stage.

4. The mechanical pulping method of claim 3 wherein the introduction of the biological includes introduction of the biological agent to at least one of directly into the fiberizer refiner stage and between the pressurized chip press stage and the fiberizer refiner stage.

5. The mechanical pulping method of claim 1 wherein the comminuted cellulosic material includes wood chips and the pre-treatment step converts at least a 40 percent (40%) of intact wood fibers in the wood chips to well separated fibers, and the primary refining step converts the defibrated cellulosic material to at least a 90 percent (90%) of fibrillated fibers.

* * * * *